US012252653B2

(12) United States Patent
Hofmeister et al.

(10) Patent No.: US 12,252,653 B2
(45) Date of Patent: Mar. 18, 2025

(54) METHOD OF OPERATING A FIXED-BED GASIFIER FOR PRODUCING A PRODUCT GAS FROM POURABLE CARBONACEOUS PARTICLES

(71) Applicant: MHR HOLDING PTE. LTD., Singapure (SG)

(72) Inventors: Michael Hofmeister, Dresden (DE); Horst Dressler, Muehlhausen (DE)

(73) Assignee: MHR Holdings PTE. Ltd.., Singapur (SG)

( * ) Notice: Subject to any disclaimer, the term of this patent is extended or adjusted under 35 U.S.C. 154(b) by 0 days.

(21) Appl. No.: 18/497,781

(22) Filed: Oct. 30, 2023

(65) Prior Publication Data

US 2024/0059990 A1 Feb. 22, 2024

Related U.S. Application Data

(63) Continuation of application No. 17/779,615, filed as application No. PCT/EP2020/083299 on Nov. 25, 2020, now abandoned.

(30) Foreign Application Priority Data

Nov. 26, 2019 (DE) ..... 10 2019 218 310

(51) Int. Cl.
*C10J 3/32* (2006.01)
*C10J 3/26* (2006.01)
(Continued)

(52) U.S. Cl.
CPC . *C10J 3/32* (2013.01); *C10J 3/26* (2013.01); *C10J 3/40* (2013.01); *C10J 3/42* (2013.01)

(58) Field of Classification Search
CPC ..... C10J 3/32; C10J 3/26; C10J 3/40; C10J 3/42
See application file for complete search history.

(56) References Cited

U.S. PATENT DOCUMENTS 1,772,643 A 8/1930 Smith
1,939,470 A 12/1933 Steere
(Continued)

FOREIGN PATENT DOCUMENTS

DE 102018205115 A1 10/2019
FI 57779 B 6/1980
(Continued)

OTHER PUBLICATIONS

Search Report received in International Application No. PCT/EP2020/083299 filed Mar. 23, 2021, with translation, 5 pages.
(Continued)

*Primary Examiner* — Matthew J Merkling
(74) *Attorney, Agent, or Firm* — Christopher A. Rothe; CM Law

(57) ABSTRACT

A method of operating a fixed-bed gasifier includes positioning a tapping element at a first point above a bed of fuel particles, lowering the tapping element into the fuel particles along a first linear path to form a first linear passage in the fuel particles, raising the tapping element to retract the tapping element from the fuel particles along the first linear path so that the tapping element exits the fuel particles from the first linear passage, positioning the tapping element at a second point above the fuel particles, lowering the tapping element into the fuel particles along a second linear path to form a second linear passage in the fuel particles, and raising the tapping element to retract the tapping element from the fuel particles along the second linear path so that the tapping element exits the fuel particles from the second linear passage.

12 Claims, 5 Drawing Sheets

(51) Int. Cl.
*C10J 3/40* (2006.01)
*C10J 3/42* (2006.01)

(56) References Cited

U.S. PATENT DOCUMENTS

| | | | | |
|---|---|---|---|---|
| 4,583,992 | A | 4/1986 | Rogers | |
| 5,226,927 | A | 7/1993 | Rundstrom | |
| 7,780,750 | B2 | 8/2010 | Carman | |
| 9,096,807 | B2 | 8/2015 | Depuy et al. | |
| 2012/0017510 | A1* | 1/2012 | Leveson | C10J 3/26 126/152 B |
| 2022/0403265 | A1* | 12/2022 | Hofmeister | C10J 3/26 |

FOREIGN PATENT DOCUMENTS

| | | | |
|---|---|---|---|
| GB | 208001 | A | 12/1923 |
| GB | 315327 | A | 8/1930 |
| GB | 460554 | A | 1/1937 |
| WO | 2011091080 | A2 | 7/2011 |

OTHER PUBLICATIONS

Written Opinion received in International Application No. PCT/EP2020/083299 dated Mar. 23, 2021, with translation, 13 pages.

* cited by examiner

METHOD OF OPERATING A FIXED-BED GASIFIER FOR PRODUCING A PRODUCT GAS FROM POURABLE CARBONACEOUS PARTICLES

CROSS-REFERENCE TO RELATED APPLICATIONS

This application is a continuation of U.S. application Ser. No. 17/779,615, filed May 25, 2022, which is the United States national phase entry of International Application No. PCT/EP2020/083299, filed Nov. 25, 2020, and claims priority to German Application No. 10 2019 218 310.7, filed Nov. 26, 2019. The contents of U.S. application Ser. No. 17/779,615, International Application No. PCT/EP2020/083299 and German Application No. 10 2019 218 310.7 are incorporated by reference herein in their entireties.

FIELD

The present invention relates to a fixed-bed gasifier for generating a product gas from pourable carbonaceous fuel particles.

BACKGROUND

During the gasification of waste, such as biomass with low-melting ashes, clinker/slag is formed in the oxidation zone, which has to be operated at more than 900° C. This clinker has different behavior depending on the fuel. The fuel may slag in its original form. This means that if the fuel is fed in pellet form, the pellets will first slag in their original form before the clinker pellets start to stick together. However, a clinker lake, or a direct clinker layer over the entire gasifier cross-section, may also develop. This is what happens with grass cobs, for example. What always happens is that the individual slagging particles sinter together in the gasifier. Now, in order to prevent clogging of the gasifier, a device is needed to break up the clinker so that combustion air can flow into the fuel-particle packed bed and the product gas can flow out of the fuel-particle packed bed. Only if the reaction in the gasifier is maintained the clinker can be conveyed further towards the support device. From DE 10 2018 205 115 A1, a fork element with a plurality of prongs is known, which is intermittently inserted into the fuel-particle packed bed and breaks up clinkers. However, the prongs of the fork element are distributed over the entire horizontal cross-section of the gasifier. This leads to excessive disturbance of the gasification process and to an increased tar loading of the product gas and thus to a deterioration of the product gas quality.

SUMMARY

It is therefore an object of the present invention to provide a fixed-bed gasifier with a clinker breaking device that degrades the quality of the product gas as little as possible.

By the possibility of positioning a tapping/spike element at different points above the fuel-particle packed bed, the tapping element can be small and can still reach all areas of the fuel-particle packed bed. During gasifying operation, the tapping element enters the fuel-particle packed bed intermittently. The prong enters/spikes into the material column linearly from above and exits again along the same path. Before the next tapping/spiking/entering, the driving means changes the position of the tapping element so that it does not retract into the same tapping passage. This repeated local tapping, temporally shifted at different locations of the fuel-particle packed bed, moves the gasifier bed and the sintering process of clinker particles, which would clog the complete gasifier cross-section, is disturbed. This also results in gas continuing to flow across the entire cross-section through each zone, not just in the 'tapped passage'. In addition, clinker lumps that have sintered together in the meantime are transported further—in the direction of the support device—or are broken up again. The movement in the gasifier bed also closes cavities in the gasifier bed created by the repeated tapping, the gasification and the sintering process. Since the gasifier bed should be disturbed as little as possible, it is important to keep the number of prongs on the tapping element as small as possible, so that the area in which the tapping element penetrates the biomass bed is as small and local as possible. However, it has to be tapped at each location over a period of time to keep the entire gasifier cross-section clear, which is achieved by changing the location of the tapping element after each tapping.

Suitable pourable fuel particles include biomass particles, particles of shredded plastics, or shredded waste particles that are carbonaceous.

An advantageous embodiment includes a rotating means by which the tapping element is rotatable to another position above the fuel-particle packed bed in the gasifier, providing a structurally simple way of positioning the tapping element at different locations above the fuel-particle packed bed.

For gasifiers with high power and thus with large horizontal cross-sectional area, it is advantageous to use a tapping element with two or three prongs.

In one embodiment, the prongs are mounted on a flat crossbar, and the driving means is configured such that the flat crossbar penetrates into the fuel-particle packed bed, enhancing the closing of cavities in the gasifier bed created by the gasification and sintering process.

In the case of gasifiers with a very high power and thus a very large horizontal cross-sectional area, it has proven advantageous to provide several clinker braking devices which are operated in parallel.

In one embodiment, the support device comprises a water cooling system that reduces the thermal load on the support device and increases the service life of the support device.

BRIEF DESCRIPTION OF THE DRAWING FIGURES

Further advantages and features of the present invention will be apparent from the following description with reference to the accompanying drawings. The following is shown:

FIG. 1*a* shows a schematic representation of a fixed-bed gasifier in a side view according to a first embodiment with a rotatable tapping element, wherein the tapping element is not inserted into the biomass;

FIG. 1*b* shows a schematic representation of the first embodiment, wherein the tapping element is inserted into a fuel-particle packed bed;

FIG. 2*a* shows a top view of a second embodiment with two clinker braking devices arranged side by side;

FIGS. 2*b* and 2*c* show side views of the second embodiment;

DETAILED DESCRIPTION

Figure 1B:
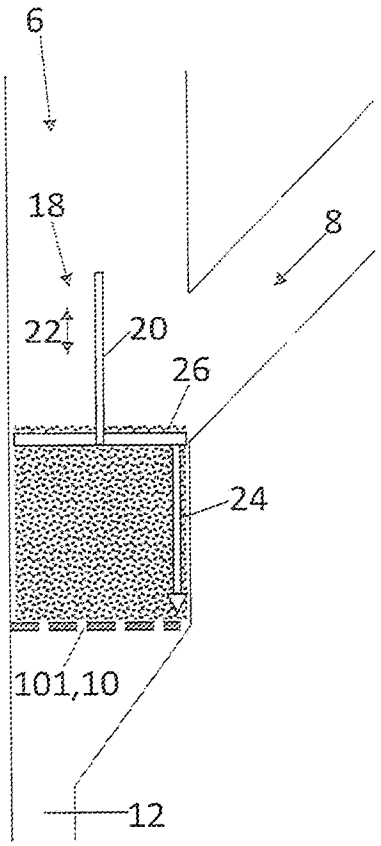
Figure 1A:
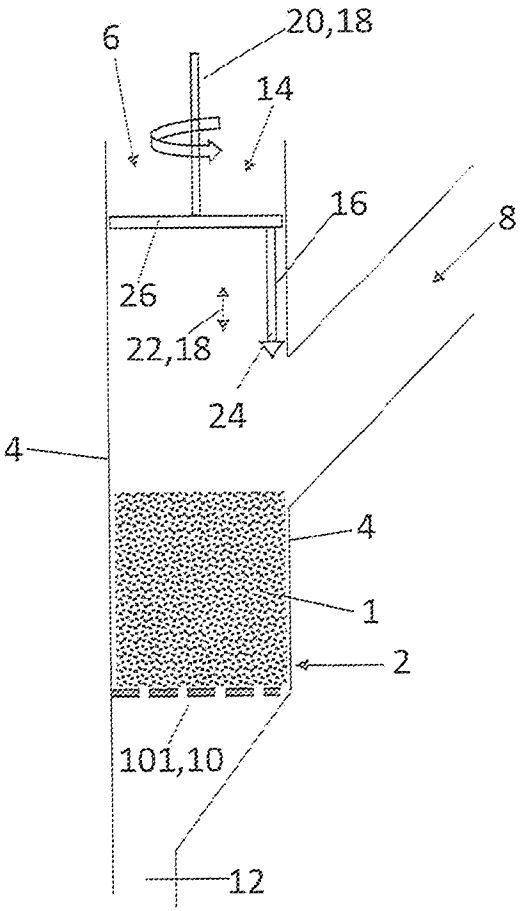

FIG. 1*a* and FIG. 1*b* schematically show a first embodiment of a fixed-bed gasifier according to the present invention for generating a product gas from pourable carbonaceous fuel particles 1 in the form of biomass particles, particles of plastic or other carbonaceous fuel particles. The fixed-bed gasifier comprises a gasifier container 2 having a rectangular cross-section with side walls 4, an air supply 6 in the upper region of the gasifier 2, a fuel supply 8 opening laterally into the gasifier 2, a support device 10 for the fuel-particle packed bed in the form of a planar horizontally arranged grate 101, a product gas and ash drain 12 from the region below the grate 10, and a clinker braking device 14.

The clinker braking device 14 includes a tapping element 16 and a driving means 18. The driving means 18 includes a rotatable shaft 20 for rotating the tapping element in a horizontal plane and a vertical movement means 22 for linearly reciprocating the tapping element 16 in a vertical direction. The tapping element 16 includes a vertically oriented prong 24 mounted on one end of a flat crossbar 26. At its other end, the flat crossbar 26 is mounted to the rotatable shaft 20. A vertical movement means 22 may be designed, for example, as a double hydraulic cylinder. The rotatable shaft 20 is preferably rotated by an electric motor.

The rotatable shaft 20 with the tapping element 16 is arranged centrally in the gasifier 2 above the fixed bed of fuel particles 1. This embodiment allows only local points to be reached on a circular line. For small gasifiers with horizontal cross-sectional areas in the range from 10000 to 25600 $mm^2$, this restriction is unproblematic. For even larger gasifier cross-sectional areas of 25600 to 42300 $mm^2$, two or three prongs may be attached to the flat crossbar 26 instead of one prong 24. For even greater gasifier power and gasifier cross-sectional areas of 42300 $mm^2$ and above, it makes sense to arrange two clinker braking devices 14 next to each other and operate them in parallel. For gasifier cross-sectional areas of 85000 $mm^2$ and above, it makes sense to use two clinker braking devices 14 arranged next to each other with two or three prongs 24.

Figure 2A:
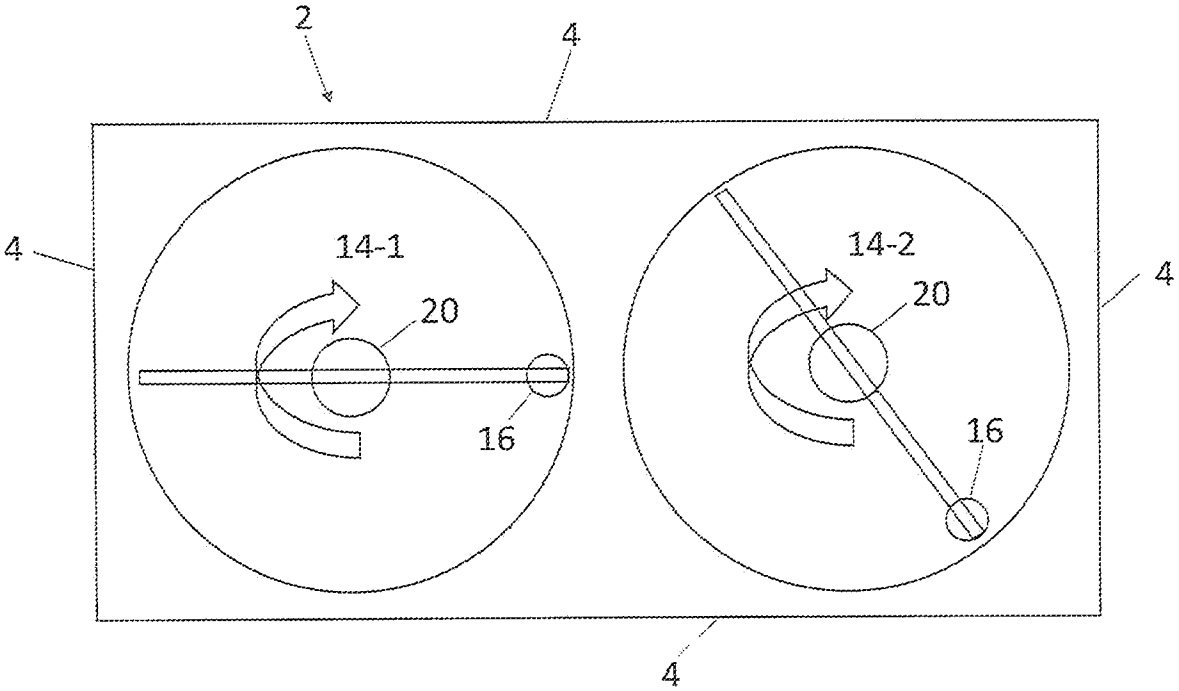
Figure 2C:
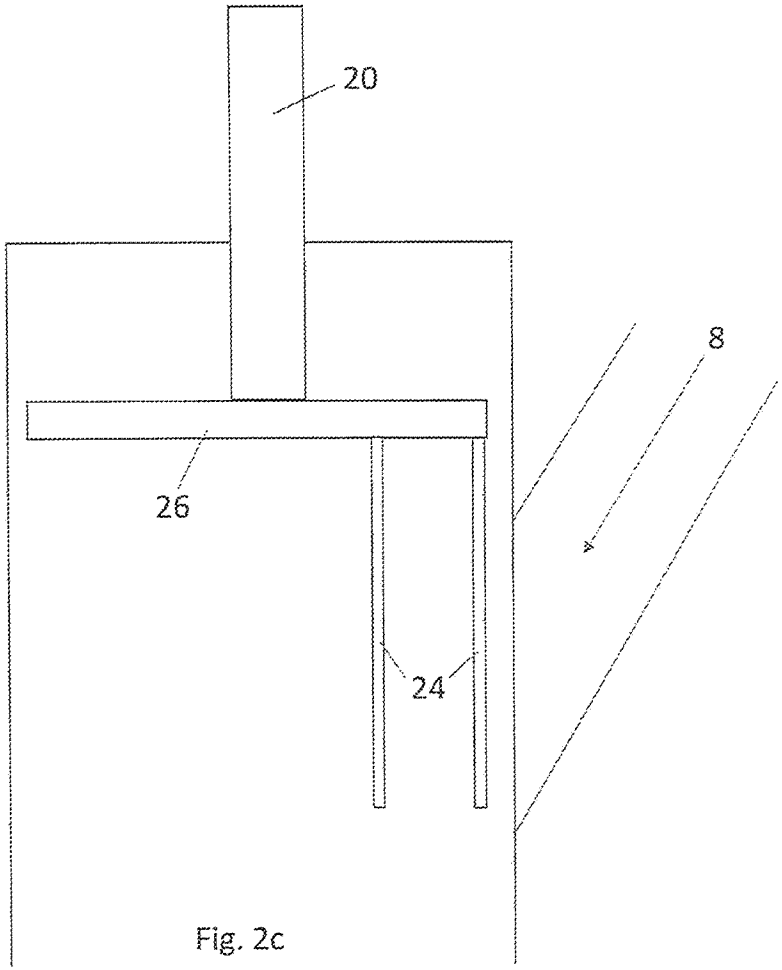
Figure 2B:
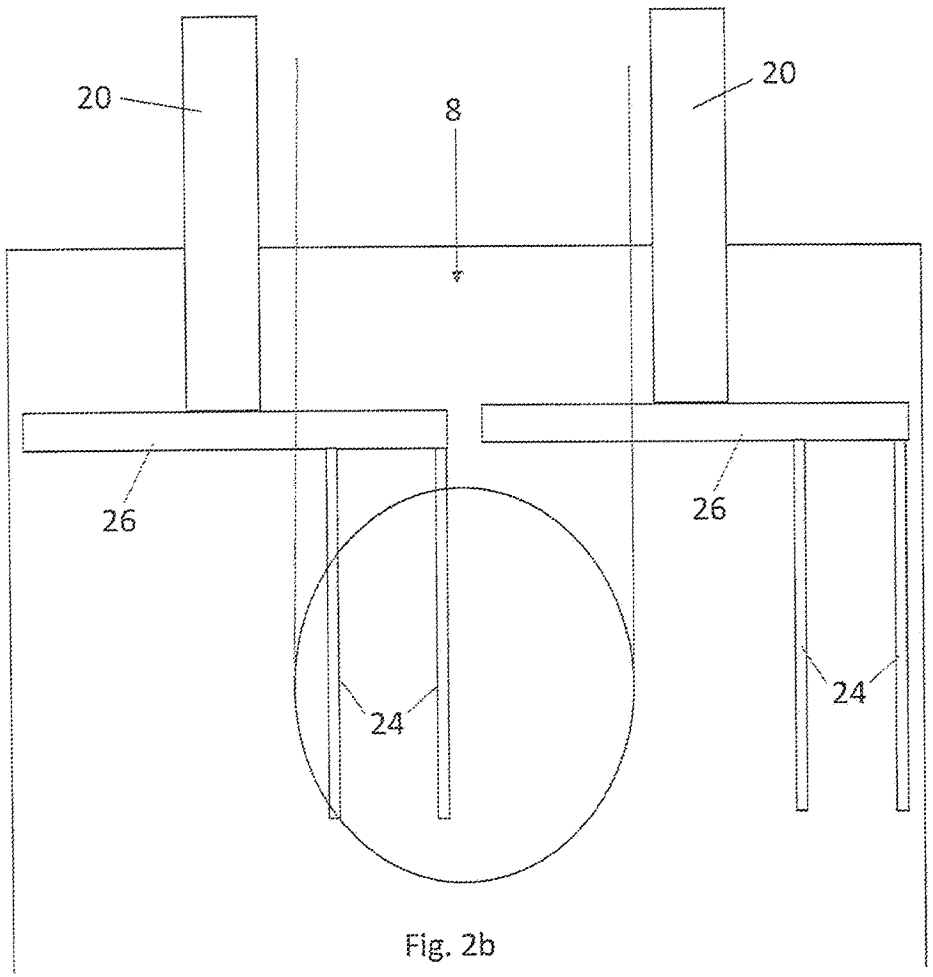

This use of two clinker braking devices 14-1 and 14-2 arranged side by side, as a second embodiment of the invention, is shown schematically in FIGS. 2*a*, 2*b* and 2*c*. FIG. 2*a* shows a top view of the open gasifier 2 with a rectangular cross-section with sides a and b, with a>b. In the rectangular gasifier cross-section 2, the two clinker braking devices 14-1 and 14-2 are shown. FIG. 2*b* shows the second embodiment in a view perpendicular to the view in FIG. 2*a*, and FIG. 2*c* shows the second embodiment in a view perpendicular to the views in FIGS. 2*a* and 2*b*.

Figure 3:
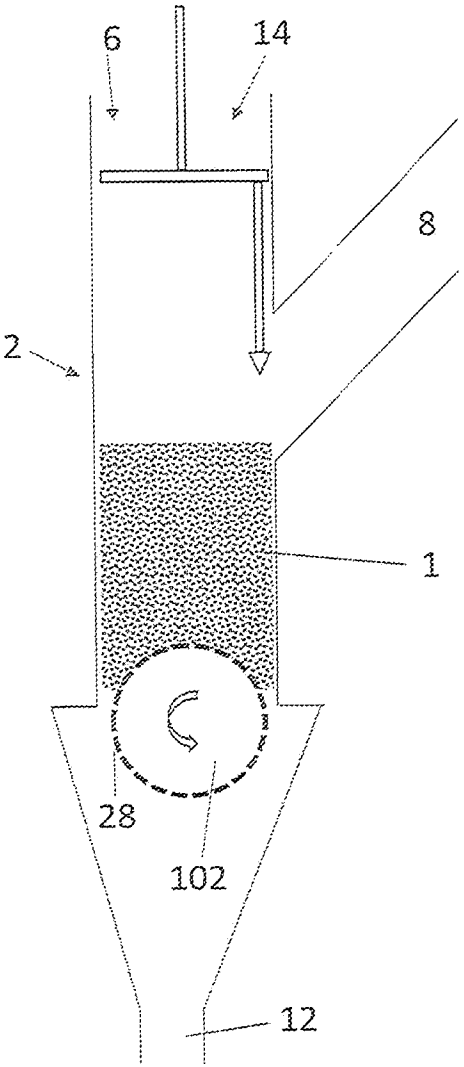
FIG. 3 shows a third embodiment.

FIG. 3 shows a third embodiment which differs from the first embodiment according to FIG. 1 in that a roller 102 rotating intermittently is provided as the support device 10 instead of the horizontal grate 101.

Figure 4:
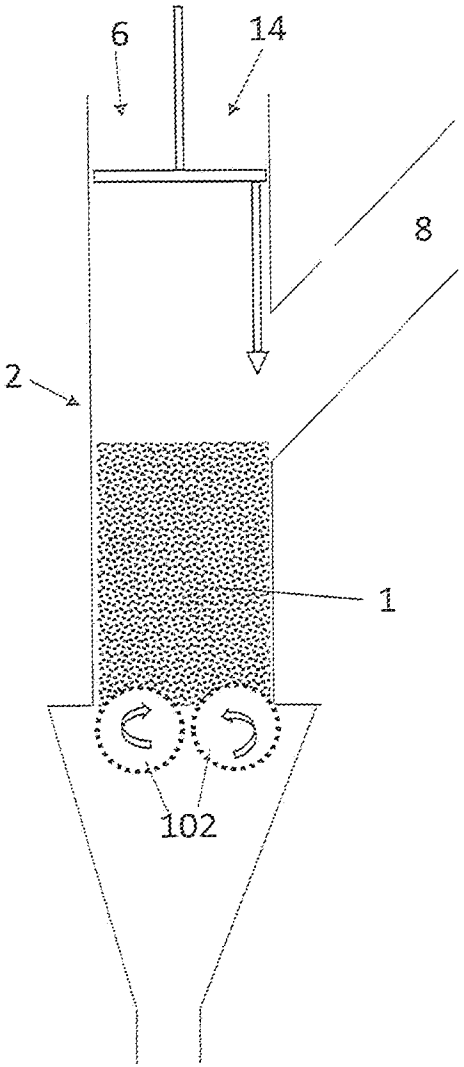
FIG. 4 shows a fourth embodiment.

FIG. 4 shows a fourth embodiment, which differs from the third embodiment according to FIG. 3 in that two rollers 102 rotating intermittently with respect to each other are provided as the support device 10 instead of one roller.

The rollers 102 are provided with teeth 28 to crush present clinker lumps.

Figure 5:
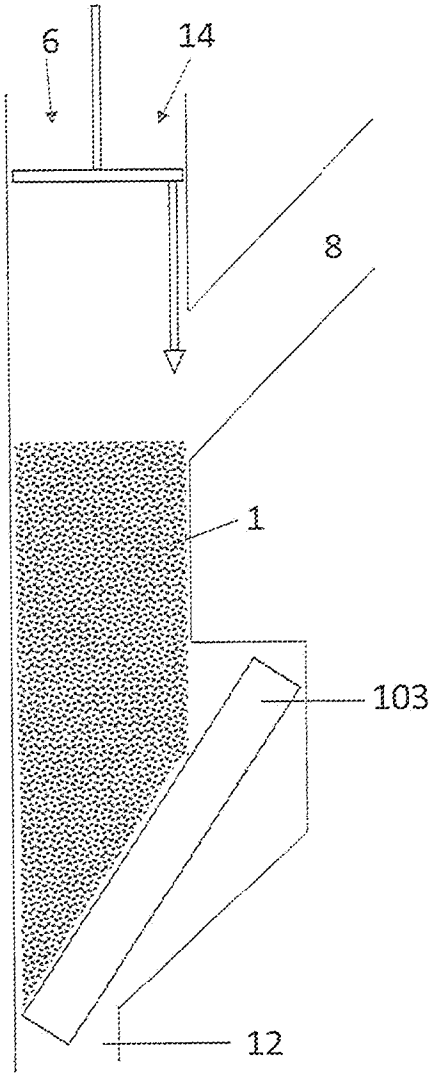
FIG. 5 shows a fifth embodiment.

FIG. 5 shows a fifth embodiment, which differs from the first embodiment according to FIG. 1 in that instead of the horizontal grate 101, an inclined grate 103 is provided as the support device 10, as is known from DE 10 2018 205 115 A1.

Figure 6:
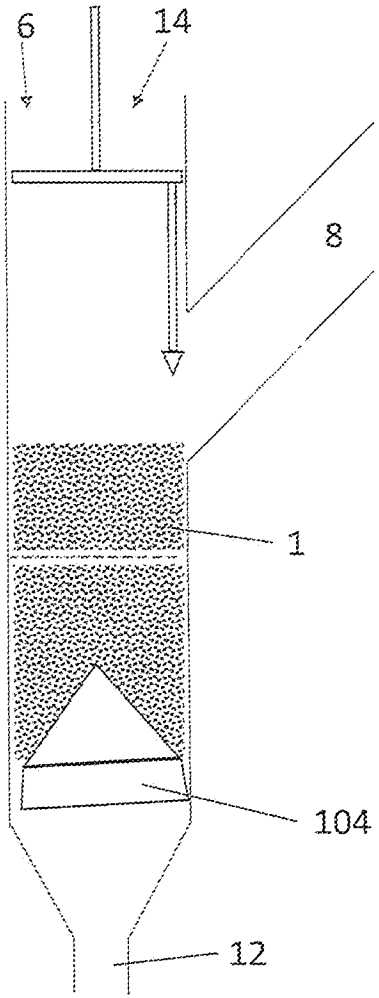
FIG. 6 shows a sixth embodiment of the invention.

FIG. 6 shows a sixth embodiment that differs from the first embodiment shown in FIG. 1 in that a tumbling cone crusher 104 is provided as a support device 10 instead of the horizontal grate 101.

During loading or start-up of the fixed-bed gasifier, the clinker braking devices 14 can also be used to distribute the fuel particles 1 in the gasifier by twisting the tapping elements 16 during filling of the fuel particles.

What is claimed:

1. A method of operating a fixed-bed gasifier for producing a product gas from a bed of fuel particles, the method comprising the steps of:

positioning at least one tapping element at a first point above the bed of fuel particles;

lowering the at least one tapping element into the bed of fuel particles along a first linear path to form a first linear passage in the bed of fuel particles;

raising the at least one tapping element to retract the at least one tapping element from the bed of fuel particles along the first linear path so that the at least one tapping element exits the bed of fuel particles from the first linear passage;

positioning the at least one tapping element at a second point above the bed of fuel particles;

lowering the at least one tapping element into the bed of fuel particles along a second linear path to form a second linear passage in the bed of fuel particles; and raising the at least one tapping element to retract the at least one tapping element from the bed of fuel particles along the second linear path so that the at least one tapping element exits the bed of fuel particles from the second linear passage the at least one tapping element being lowered and raised to minimize disturbance of fuel particles around the first linear passage and the second linear passage.

2. The method according to claim 1, wherein the at least one tapping element comprises a spike.

3. The method according to claim 2, wherein the spike is oriented vertically.

4. The method according to claim 2, wherein the at least one tapping element comprises a first tapping element with a first spike and a second tapping element with a second spike.

5. The method according to claim 4, wherein, when the first tapping element and the second tapping element are lowered into the bed of fuel particles, the first spike forms a first spike passage in the bed of fuel particles and the second spike forms a second spike passage in the bed of fuel particles.

6. The method according to claim 4, wherein the first spike and the second spike extend parallel to one another.

7. The method according to claim 1, wherein the at least one tapping element is centrally arranged relative to the bed of fuel particles.

8. The method according to claim 7, wherein the step of positioning the at least one tapping element at a second point above the bed of fuel particles comprises rotating the at least one tapping element in a horizontal plane above the bed of fuel particles.

9. The method according to claim 8, wherein the first point above the bed of fuel particles and the second point above the bed of fuel particles are located on a circular line.

10. The method according to claim 1, wherein the steps of lowering the at least one tapping element into the bed of fuel particles along a first linear path and lowering the at least one tapping element into the bed of fuel particles along a second linear path comprise lowering the at least one tapping element in a vertical direction so that the first linear passage and the second linear passage are vertical.

11. The method according to claim 1, wherein the steps of lowering the at least one tapping element into the bed of fuel particles along the first linear path and raising the at least one tapping element to retract the at least one tapping element from the bed of fuel particles along the first linear path are performed in reciprocating manner.

12. The method according to claim 1, wherein the at least one tapping element comprises a first tapping element on a first clinker device and a second tapping element on a second clinker device arranged side by side with the first clinker device.

* * * * *